US005192133A

United States Patent [19]

Juel et al.

[11] Patent Number: 5,192,133

[45] Date of Patent: Mar. 9, 1993

[54] FLEXIBLE CONTAINER WITH IMPROVED BOTTOM AND TOP

[75] Inventors: Anders Juel; Olaf Strand; Bjarne Omdal, all of Porsgrunn; Roger Lysfjord, Stathelle, all of Norway

[73] Assignee: Norsk Hydro a.s., Oslo, Norway

[21] Appl. No.: 752,559

[22] PCT Filed: Feb. 28, 1990

[86] PCT No.: PCT/NO90/00039

§ 371 Date: Sep. 10, 1991

§ 102(e) Date: Sep. 10, 1991

[87] PCT Pub. No.: WO90/09929

PCT Pub. Date: Sep. 7, 1990

[30] Foreign Application Priority Data

Feb. 28, 1989 [NO] Norway ..... 890860

[51] Int. Cl.[5] ..... B65D 30/04; B65D 30/20; B65D 33/10

[52] U.S. Cl. ..... 383/7; 383/8; 383/109; 383/120

[58] Field of Search ..... 383/7, 8, 120, 109

[56] References Cited

U.S. PATENT DOCUMENTS

| | | | |
|---|---|---|---|
| 2,819,834 | 1/1958 | Brady | 383/120 |
| 2,915,098 | 12/1959 | McKay, Jr. et al. | 383/120 |
| 3,094,083 | 6/1963 | Weeks | 383/109 |
| 3,263,901 | 8/1966 | Hoelzer | 383/120 |
| 3,349,991 | 10/1967 | Kessler | 383/120 |
| 3,670,953 | 6/1972 | Leventhal | 383/120 |
| 3,670,954 | 6/1972 | Leventhal | 383/120 |
| 3,758,024 | 9/1973 | Bethke et al. | 383/120 |
| 4,136,723 | 1/1979 | Skaadel et al. | 383/8 |
| 4,174,804 | 11/1979 | Bosse | 383/120 |
| 4,269,247 | 5/1981 | Omdal | 383/8 |
| 4,508,222 | 4/1985 | Choe | 383/120 |
| 4,550,442 | 10/1985 | Lepisto | 383/120 |
| 4,584,705 | 4/1986 | Myklebust et al. | 383/8 |
| 4,750,846 | 6/1988 | Myklebust et al. | 383/8 |
| 4,759,742 | 7/1988 | Achelpohl | 383/120 |
| 4,832,506 | 5/1989 | Juel et al. | 383/8 |
| 4,925,317 | 5/1990 | Myklebust et al. | 383/8 |

FOREIGN PATENT DOCUMENTS

| | | | |
|---|---|---|---|
| 945953 | 4/1974 | Canada | 383/120 |
| 2526961 | 5/1976 | Fed. Rep. of Germany | 383/120 |

*Primary Examiner*—Stephen P. Garbe
*Attorney, Agent, or Firm*—Wenderoth, Lind & Ponack

[57] ABSTRACT

The present invention relates to a flexible intermediate bulk container (FIBC) for transportation, storage and lifting of bulk material. The container has improved bottom and top construction, and it comprises a hose shape blank made from a round woven fabric or from at least one piece of flat woven fabric joined at its bottom and/or top end after folding the blank in three or more longitudinal folds each consisting of two layers. The length of the joint(s) is less than ¼ of the container circumference. The FIBC has a filling opening, possibly a liner and might have a lifting loop which is formed by integral extensions of the side walls of the blank.

8 Claims, 4 Drawing Sheets

FIG. 2g
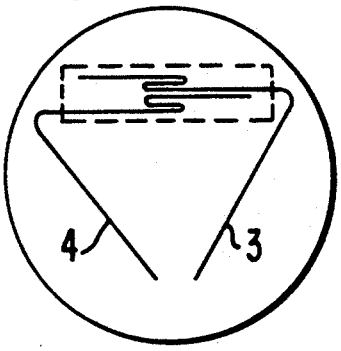
FIG. 2a
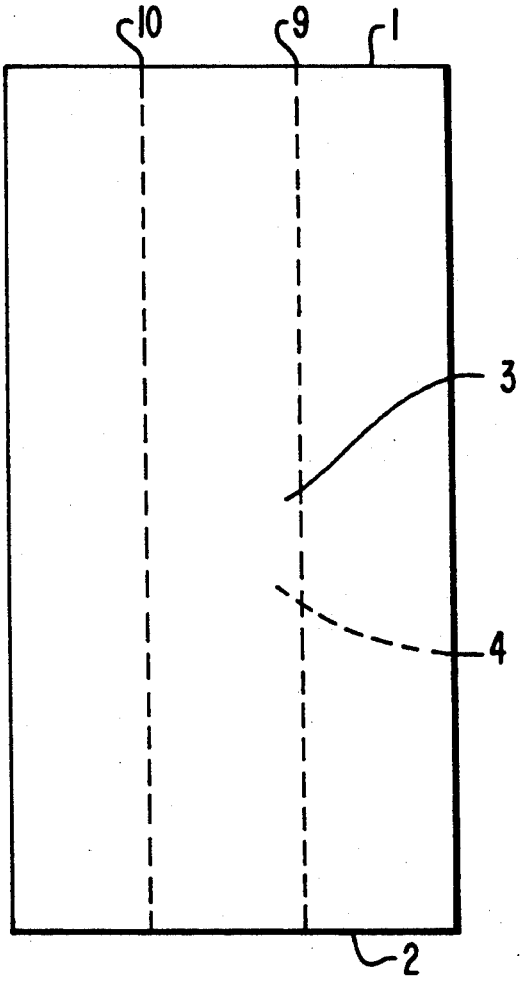
FIG. 2b
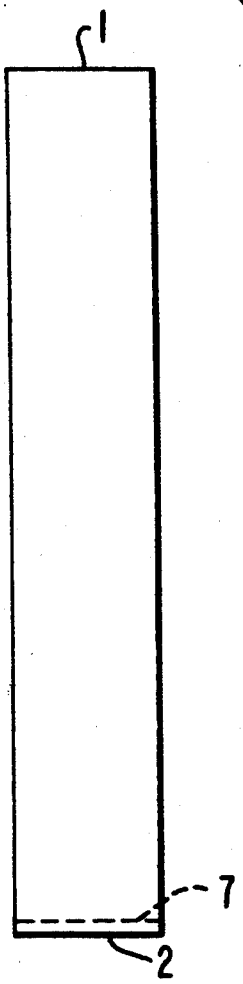
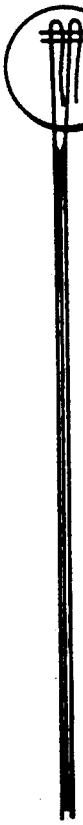
FIG. 2c
FIG. 2d
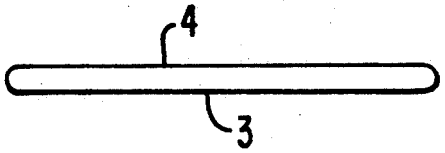
FIG. 2e
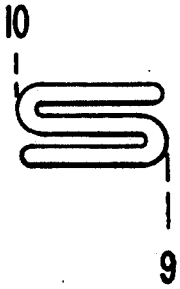
FIG. 2f
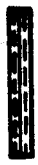

FLEXIBLE CONTAINER WITH IMPROVED BOTTOM AND TOP

BACKGROUND OF THE INVENTION

The present invention relates to a flexible intermediate bulk container (FIBC) for lifting, transportation and storage of bulk material. Such FIBC comprises a hose-shaped blank that is woven in such shape or is made from at least one piece of flat woven material joined together and having joints at its bottom and/or top ends. The FIBC also includes at least one lifting loop which might be formed from integral extensions of the container side walls, a filling opening and possibly also a liner.

The blank as defined herein can be made from round woven material or at least one piece of flat woven material joined together for forming at least one side joint or seam. Such joining together can for instance be performed subsequent to joining of the bottom and/or top joints.

FIBCs have been used for some time and have proved to be suitable for transportation, lifting and storage of bulk material such as granular fertilizer, ground and unground grain, Portland cement, coal, etc., in quantities of several hundred kilos per container.

The prior art reveals that the FIBCs are difficult to manufacture with a high degree of mechanization. Even relatively simple operations like cutting of the blank, folding and sewing of side and bottom seams are done manually. If the production of the container could be mechanized the manufacture costs would be reduced due to reduction in manual labor.

Previously known FIBCs for transportation of bulk material, e.g. from U.S. Pat. No. 4,269,247 (corresponding to NO U.S. Pat. No. 136,744), are made from a blank of flat woven fabric, and are formed by folding the blank at a transverse center line thereof and sewing the sides and the bottom. The middle section of the blank forms in the finished product a lifting loop which is an integral extension of the side walls. However, the container according to U.S. Pat. No. 4,269,247 was made with a squarish base by making gussets at opposite sides of the hose shaped blank before the base was sewn. The disadvantages of this construction are firstly that the containers are expensive to manufacture due to the long side seams and secondly that it is a difficult operation to make the gussets after the side seams have been made.

Further, there is known a container according to U.S. Pat. No. 4,136,723 (Norwegian Patent No. 138,134) which can be made from a round woven fabric. When such container is made from a round woven fabric, there will be no side seams. This container has a double base construction comprising one or two seams each having a length of ¼ of the container circumference.

Neither of the two containers described in such U.S. patents are suitable for mechanized production and both such containers require a relatively large storage volume when empty.

SUMMARY OF THE INVENTION

Thus, the object of the invention is to provide an improved FIBC where:

- the production can be fully mechanized both with and without a liner
- even stress distribution in the top and bottom part is attained
- raw material costs are reduced
- the transport and storage volume of the empty folded container is low.

To meet the above objects, the inventors had to find ways to manufacture the FIBC which were suitable for mechanization. The starting point in the production of the FIBCs was to employ round woven fabric in the form of a hose shaped blank. The round woven fabric versus flat woven fabric possesses one great advantage, i.e. it does not have side seams. Side seams reduce the circumferential strength and increase the manufacturing costs of the FIBC. The present invention should therefore provide a reduction in the total seam length.

The simplest solution to the problem of how to make an FIBC with short seam length seemed to be a prefolded container which also was suitable for mechanized production. Preliminary tests indicated that the hose shaped blank folded one or twice longitudinally and then joined by a transverse seam at the bottom was strong and well suited for mechanized production. In fact, the number of foldings was not restricted to only once or twice, but it might include any practical number. The preliminary tests further showed that if the seam was positioned in the center of the bottom area of the container when filled or inflated, a container accordingly would have a circular base. Both the positioning of the seam and the circular base will provide a container with a more uniform and equal distribution of stress at the lower part of the FIBC. The method of prefolding the container was further possible to employ when the FIBC had gusseted sides as described in CA Patent No. 1,221,923 (Norwegian Patent No. 153,250).

The woven material used to manufacture the container need not be woven fabric, but in fact can be of any type suitable, e.g. flexible and elastic materials, single or multiple layer composite construction, coated or uncoated, etc.

The special features of the present invention are that the hose shaped blank is laid flat and folded parallel to the longitudinal axis thereof a number of times required to make the minimum layers of fabric more than four, whereafter the bottom and/or the top is sealed. There are various ways to achieve this. One way is to make infolded pleats or gussets at opposite sides of the blank, whereafter the hose shaped blank is folded at least once along the longitudinal center axis thereof. A joint is made transversely at the bottom and/or top. Another method to manufacture a container with at least six layers of fabric when it is laid flat is simply to fold the hose shaped blank two times longitudinally. This method will achieve a hose shaped blank with six layers of fabric. These two methods to fold the hose shaped blank are meant as examples only. There are various other ways to fold the blank longitudinally to attain at least six layers of fabric.

The total length of the bottom seam in the previously mentioned U.S. patents is ½ of the container circumference, whereas the length of the bottom seam of the present invention is less than ¼ of the container circumference. The seam or joint at the bottom of the present invention will, when the bag is filled or inflated, be in the center of the base. Because the stress at the center of the base is relatively low, the seam at this point is not as critical as at the base seam in U.S. Pat. No. 4,269,247, the length of which is equal to the full width of the base area.

The manufacturing process of the present invention is simple and can be highly mechanized. The container preferably is manufactured from an "infinitely" long hose shaped material with or without gusseted sides which is cut perpendicular to the longitudinal axis to thus form the top and bottom of the blank. The container is folded at least once along the longitudinal axis, and a joint or seam is formed at the bottom and/or the top part of the container. Cutting, folding and joining can be mechanized.

The scope of the present invention is defined in the attached claims. The main characterizing features of the invention are that the bottom and/or the top joints are formed subsequent to forming longitudinal folded sections in the blank, each consisting of two layers of material, and that the length of such joint(s) is less than ¼ of the container circumference. In its most preferred embodiment, the hose shaped blank has longitudinal folds along the center axis and a joint across one or both ends with a length corresponding to approximately ⅛ of the container circumference. Another embodiment provides that the blank has two folds defining three folded sections, each having a width corresponding to 1/6 of the circumference of the container, and a joint across one or both ends. Further, the invention provides that a liner may be fastened to the bottom joint of the hose shaped blank.

BRIEF DESCRIPTION OF THE DRAWINGS

The container and the method of manufacture thereof of the invention will be described in more detail below, by the way of example only, with reference to the accompanying drawings in which:

FIG. 1*a* is a front elevation view of the blank unfolded,

FIG. 1*b* is a front elevation view of the blank folded along a longitudinal axis thereof and with a bottom joint, FIG. 1*c* is a side view of the blank indicated in FIG. 1*b* and with top joint, and FIGS. 1*d*–1*f* are views from above of FIGS. 1*a*–1*b*, respectively;

FIGS. 2*a*–2*g* illustrate a hose shaped blank in a flattened position, where:

FIG. 2*a* is a front elevation view of an unfolded blank,

FIG. 2*b* is a front elevation view of the blank indicated in FIG. 2*a* shown folded and with a bottom joint, FIG. 2*c* is a side view of the blank indicated in FIG. 2*b* and with an alternative top joint and a bottom joint, FIGS. 2*d*–2*f* are views from below of FIGS. 2*a*–2*c*, respectively, and FIG. 2*g* is an enlarged view of a top portion of FIG. 2*c*;

FIG. 3*a* is a front elevation view of the unfolded blank with a liner positioned between the gussets thereof, FIG. 3*b* is a front elevation view of the blank folded along a longitudinal axis thereof and with top and bottom joints, FIG. 3*c* is a side view of FIG. 3*b* and including a top sleeve, FIG. 3*d* is a view from above of FIG. 3*a*, and FIG. 3*e* is an enlarged section taken along line 3*e*—3*e* of FIG. 3*b*.

DETAILED DESCRIPTION OF THE INVENTION

Figure 1A:
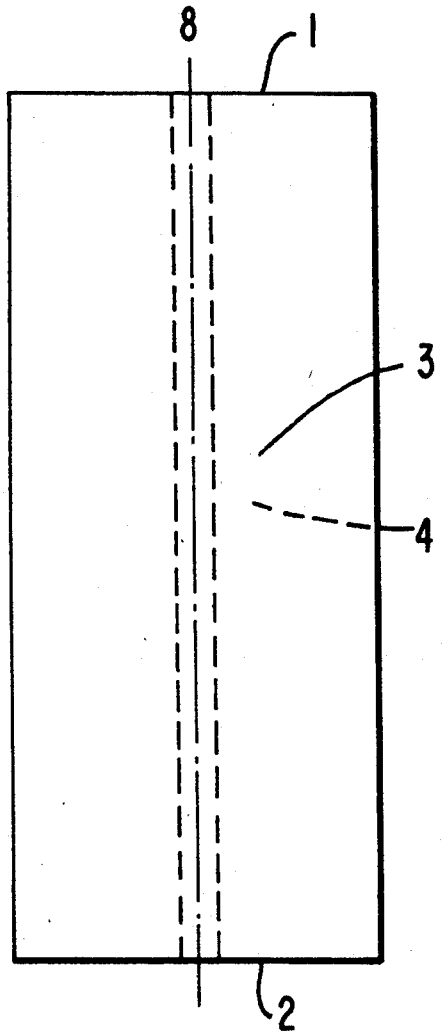
FIGS. 1*a*–1*f* illustrate a hose shaped blank with gusseted sides where.

FIG. 1*a* illustrated an unfolded piece of a hose shaped blank material with an open top 1 and bottom 2. The hose shaped blank has a front panel 3, a back panel 4 and gusseted sides 5, 6. The hose shaped blank can be manufactured either from a flat woven fabric including one or more side seams, or it can be manufactured as a round woven fabric. If the hose shaped blank is made from a flat woven fabric, it might be transversely folded at its longitudinal center which will form the bottom or a lifting loop of the finished manufactured container.

The container has a transverse joint 7 which constitutes the bottom of the container. The joint 7 can be a sewn seam or any other appropriate joint for the specific application and woven material required. The diameter and length of the hose shaped blank and the width of the gusseted sides should be defined depending on what volume is needed. The blank is formed by cutting a required length of material from a continuous length supply, and the cutting operation is perpendicular to the longitudinal axis 8 of the blank.

Figure 1B:
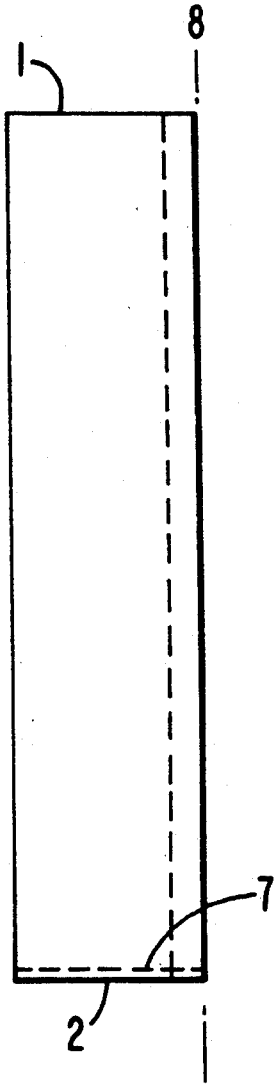
Figure 1C:
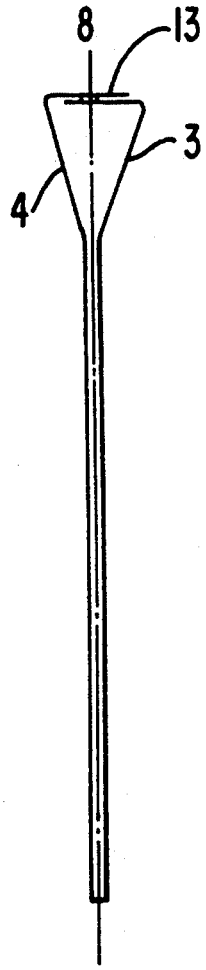
Figure 1D:
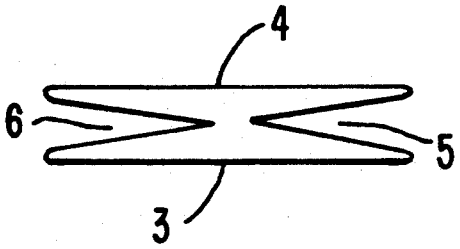
Figure 1E:
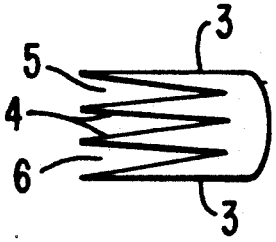
Figure 1F:
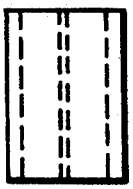

FIG. 1*b* illustrates the hose shaped blank when it is doubled by folding the material along longitudinal center axis 8. An end view of the arrangement of FIG. 1*b* is shown in FIG. 1*e*. As one can seen from the end view of FIG. 1*e*, the material section now comprises a total number of eight layers of woven fabric, and the width of the material section shown in FIG. 1*a* has been halved. It of course is possible to double the hose shaped blank shown in FIG. 1*b* one or several times more if desired. The bottom joint 7 is made transversely to the longitudinal axis 8 and relatively close to the bottom opening 2. FIG. 1*c* illustrates by example only a lifting loop 13 made by overlapping two integral extensions of outer side wall portions of the blank. The lifting loop 13 construction is not restricted to that shown, but may as well comprise a joint similar to the bottom joint.

FIGS. 2*a*–2*g* illustrate a second method of obtaining at least six layers of fabric by folding a hose shaped blank longitudinally. FIG. 2*b* shows an example where the hose shaped blank has been folded twice. The first fold is made at a distance corresponding to 1/6 of the circumference of the blank along line 9, whereas the second fold is made at an equal distance along line 10. A lifting loop 14 illustrated in FIGS. 2*c* and 2*g* is made according to the NO Patent Application No. 883,257. The bottom seam 7 will have a length equal to 1/6 of the circumference of the blank.

Figure 3A:
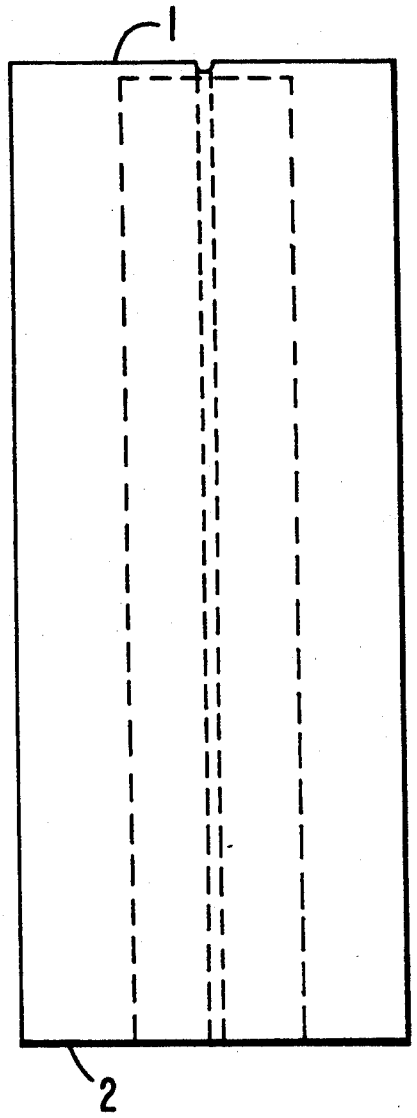
FIGS. 3*a*–3*e* illustrate the hose shaped blank with gusseted sides as shown in FIG. 1*a*, where.
Figure 3B:
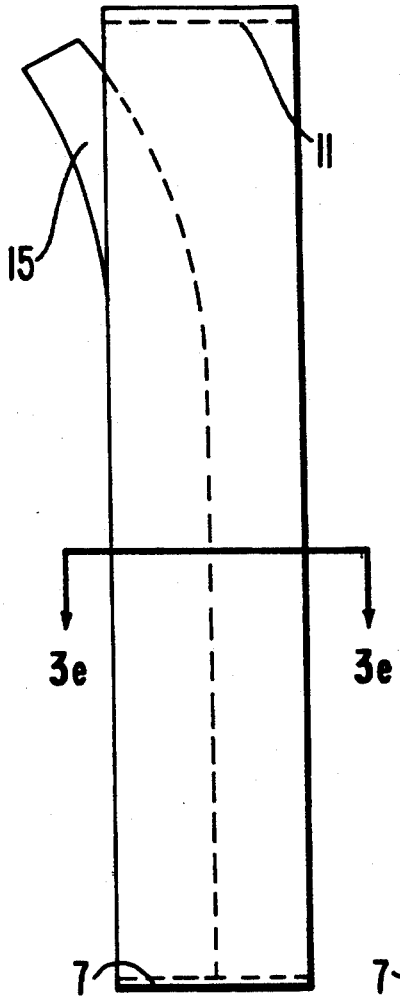
Figure 3C:
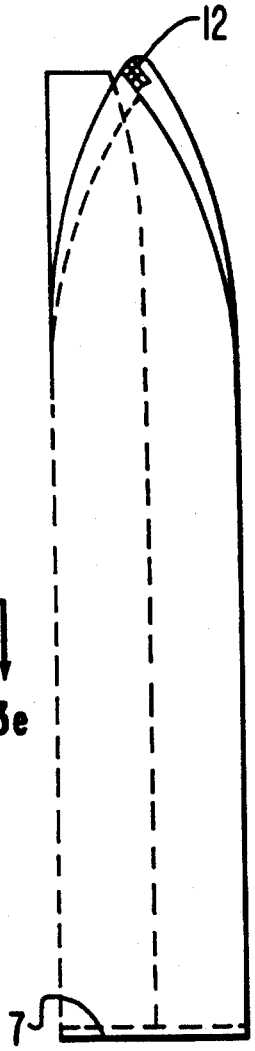
Figure 3D:
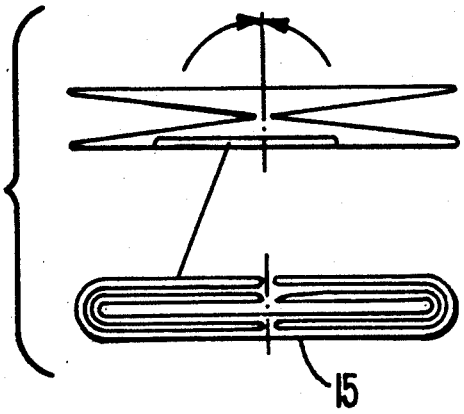
Figure 3E:
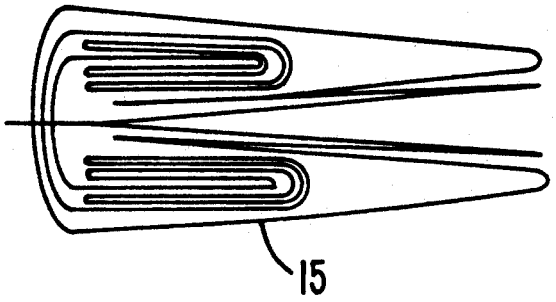

FIGS. 3*a*–3*e* illustrate the hose shaped blank shown in FIG. 1*a*, but with a liner 15 positioned inside the hose shaped blank. FIG. 3*b* shows a folded blank with two joints, i.e. a bottom joint 7 and a top joint 11. The liner 15 can be fastened to the bottom joint. By cutting at least two longitudinal slots close to the top end of the hose shaped blank, it is possible to form an opening for a lifting means. If the blank is made of a flat woven fabric, the corresponding opening for the lifting means is formed by sewing the side seam close to, but not up to the top part of the blank. The lifting loop can include a sleeve 12 as described in NO Patent Application No. 830,718.

Figure 4:
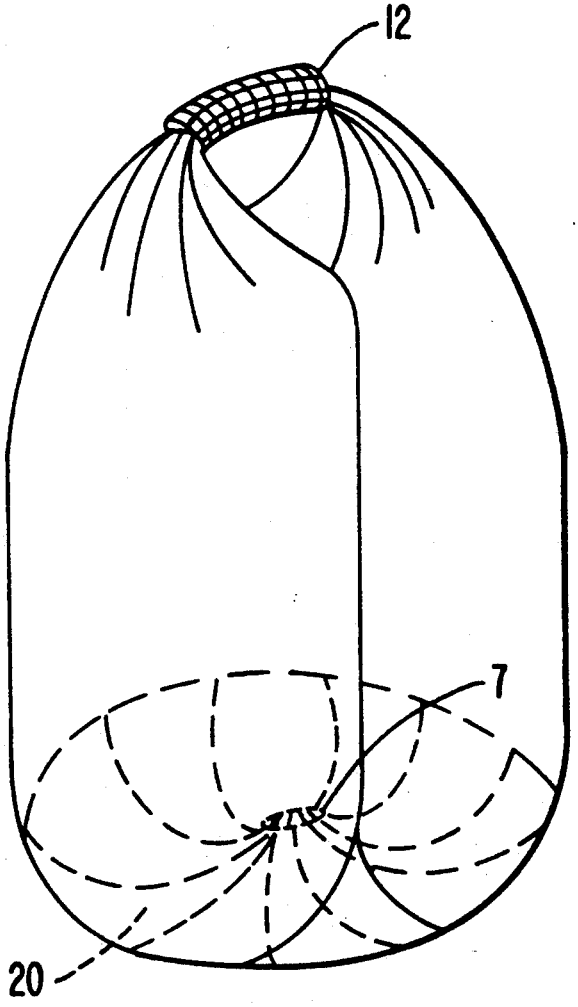
FIG. 4 is a perspective view illustrating a filled or inflated flexible container with an integral lifting loop and a bottom, both according to the invention.

FIG. 4 illustrates that the bottom of the flexible container will be rosette shaped. The seam 7 will, when the flexible container is filled or inflated and made according to the example illustrated in FIGS. 1a–1f, point vertically into the center axis of the container bottom 20. This has two great advantages, firstly that the bottom 20 is very strong because of even stress distribution, and secondly that the seam is not exposed to frictional wear and tear during transportation of the container. A FIBC made according to the invention will therefore also be safer. The stress is uniformly and equally distributed from the walls to the bottom without any stress distribution peaks due to the circular shape of the bottom. The seam in the bottom is actually located at the point of lowest stress. The FIBC shown in FIG. 4 also includes a sleeve 12.

Tests were carried out to compare the tension strength of flexible containers according to U.S. Pat. No. 4,269,247, U.S. Pat. No. 4,136,723 and the present invention. The present invention was manufactured according to FIGS. 1a–1f and included a sleeve 12. The containers were filled with approximately 500 kg of free flowing material and the test rig used is as described in NO Patent No. 152,870. The containers were first stretched five times to a load twice the weight of the container and then stretched to rupture. The load at rupture and the place of rupture are stated in table 1. All test containers were made of the same polypropylene fabric having a dimension of 1250 mm×2000 mm (plane width×length). The results are shown in table 1.

The containers used in tests 1 were made according to U.S. Pat. No. 4,269,247 and included a flat woven fabric, folded transversely at its center axis and having seams in the wall and base structure. Each container included an integral lifting loop at which all the vertical fibers in the wall structure were engaged to carry the load. This container design provides a lifting loop with the highest rupture load possible without increasing the fabric strength.

The containers used in tests 2 were a slightly modified version of the containers used in tests 1. The top and sides were made according to U.S. Pat. No. 4,269,247, whereas the bottom was made according to the invention as illustrated in FIG. 1a and 1b. Each container was formed from a flat-woven fabric folded transversely at its longitudinal center and having side and bottom seams. The side walls were gusseted, whereafter the hose shaped blank was folded along the longitudinal axis and joined by a seam at the bottom 7. By comparing the containers in tests 1 with the containers used in tests 2, it is possible to obtain an indication of what effect the bottom design according to the invention has on the load carrying capacity of the container.

The containers used in tests 3 were made according to U.S. Pat. No. 4,136,723, which in the preferred example were made from a round woven hose shaped blank with a double base construction comprising two seams each having a length of ¼ of the container circumference. A lifting loop was formed by joining integral extension of the side walls at a single seam.

The containers used in tests 4 were made according to the present invention as seen in FIG. 1 and FIG. 4. The lifting loop includes a sleeve and was formed by overlapping the two integral extensions of the side walls before sewing. Previous tests have indicated that the strength of this lifting loop is as strong as the lifting loop described in tests 1.

TABLE 1

| Container No. | Container construction | Place of Rupture | Rupture load (kN) |
|---|---|---|---|
| 1.1 | Acc. to U.S. Pat. No. 4,269,247 | Bottom | 32 |
| 1.2 | Acc. to U.S. Pat. No. 4,269,247 | Bottom | 32 |
| 2.1 | Acc. to U.S. Pat. No. 4,269,247 Modified | Bottom | 37 |
| 2.2 | Acc. to U.S. Pat. No. 4,269,247 Modified | Top fabric | 38 |
| 3.1 | Acc. to U.S. Pat. No. 4,136,723 | Lifting loop | 30.5 |
| 3.2 | Acc. to U.S. Pat. No. 4,136,723 | Lifting loop | 31 |
| 4.1 | Acc. to the present invention | Top fabric | 36 |
| 4.2 | Acc. to the present invention | Top fabric | 38 |

The tests gave the following results:

Tests 1.1–1.2 showed rupture at a load of 32 kN and the place of rupture was at the bottom, whereas the modified container in tests 2.1–2.2 had a mean value of the rupture load of 37.5 kN. Tests 2 have a rupture load approximately 20% above tests 1. Tests 2 also show that the bottom construction has a rupture load equal to the maximum load carrying capacity of the container, as one container ruptured at the top and one at the bottom.

Tests 3.1–3.2 shows rupture at a load of 31 kN, whereas the mean value of the rupture load of tests 4.1–4.2 was 37. The rupture load of tests 4 is also approximately 20% above the rupture load of tests 3. Tests 4 show that it is impossible to increase the load carrying capacity further without increasing the strength of the fabric itself. This is obvious because the place of rupture is not in the lifting loop or in the bottom part, but in the wall fabric close to the lifting loop.

The test results indicate clearly that the container according to the invention given increased load carrying capacity compared to the containers of U.S. Pat. No. 4,269,247 and U.S. Pat. No 4,136,723. With a bottom construction according to the present invention, load carrying capacity is approximately 20% above that of the containers according to such U.S. patents.

The simple method of cutting, joining the bottom and folding the hose shaped blanks used in the tests shows also that the manufacture of the container according to the present invention can be highly mechanized.

A further effect of the present invention is that the container when empty has a low volume during storage and transportation compared to previously known containers. Such low volume is an effect of the folding according to the invention.

The present invention provides a container construction which can be manufactured with a high degree of mechanization and at the same time achieving an increased load carrying capacity. These advantages are achieved by making a container which has a design where a cutting operation is simple, sewing has been minimized and folding is suitable for mechanization. All the aforementioned manufacturing steps of flexible container according to the invention, i.e. cutting of the blank, making the gussets, prefolding the hose shaped blank and sewing, can be achieved by use of relatively simple, fast operating and inexpensive manufacturing equipment.

We claim:

1. A flexible intermediate bulk container for the transportation and storage of bulk material, said container comprising:

a hose shaped blank of woven material, said blank having a longitudinal axis, a top and a bottom;

said blank having formed therein at least two longitudinal folds extending parallel to said axis and defining at least three folded blank sections each including two layers of said woven material, with said at least three folded blank sections being superimposed, thus defining at least six superimposed layers of said woven material;

at least one of said top and said bottom of said blank having a seam extending transverse to said axis and formed by joining said at least six superimposed layers of woven material, said seam having a length in a direction transverse to said axis equal to less than one-quarter of the circumference of said hose shaped blank and therefore of said container; and said top of said blank having therein a filling opening for filling bulk material into said container and having at least one lifting loop formed by at least one integral extension of the entire circumference of said blank of woven material.

2. A container as claimed in claim 1, wherein said top of said blank has a respective said seam.

3. A container as claimed in claim 2, wherein said bottom of said blank has a respective said seam.

4. A container as claimed in claim 1, wherein said bottom of said blank has a respective said seam.

5. A container as claimed in claim 1, wherein said longitudinal folds include inwardly folded gussets formed in opposite side portions of said blank and an additional fold around said axis, thereby defining a total of eight superimposed layers of woven material, and wherein said length of said seam is equal to one-eighth of said circumference of said blank.

6. A container as claimed in claim 1, wherein said blank has formed therein two said folds, thereby defining three said folded sections each having a width in a direction transverse to said axis equal to one-sixth of said circumference of said blank.

7. A container as claimed in claim 1, wherein said seam is formed at said bottom of said blank, and further comprising a line positioned within said blank and having a bottom end fastened in said seam.

8. A container as claimed in claim 1, having an internal capacity sufficient to container several hundred kilos of bulk material.

* * * * *